United States Patent [19]

Caldwell

[11] Patent Number: 5,022,337

[45] Date of Patent: Jun. 11, 1991

[54] LIFT PRODUCING DEVICE EXHIBITING LOW DRAG AND REDUCED VENTILATION POTENTIAL AND METHOD FOR PRODUCING THE SAME

[76] Inventor: Richard A. Caldwell, 115 Wimico Dr., Indian Harbour Beach, Fla. 32937

[21] Appl. No.: 339,491

[22] Filed: Apr. 17, 1989

[51] Int. Cl.[5] ..... B63B 35/79

[52] U.S. Cl. ..... 114/39.2; 114/127; 114/140; 114/274; 441/79

[58] Field of Search ..... 441/79; 114/140, 127, 114/274, 39.2

[56] References Cited

U.S. PATENT DOCUMENTS

| | | | |
|---|---|---|---|
| 3,946,688 | 3/1976 | Gornstein | 114/274 |
| 4,325,154 | 4/1982 | Collum, Jr. | 441/79 X |
| 4,850,917 | 7/1989 | Wilson et al. | 441/79 |

FOREIGN PATENT DOCUMENTS

| | | | |
|---|---|---|---|
| 3442921 | 6/1986 | Fed. Rep. of Germany | 114/127 |
| 8603222 | 7/1988 | Netherlands | 441/79 |

OTHER PUBLICATIONS

Canard Fin System, Fin Futures, "Windsurf Magazine", Oct. 1986, pp. 54, 55, 63.

*Primary Examiner*—Sherman Basinger
*Attorney, Agent, or Firm*—Antonelli, Terry, Stout & Kraus

[57] ABSTRACT

A lift producing device is disclosed which is adapted to be connected to a vehicle to provide lift to the vehicle when the vehicle is moved relative to a first fluid medium having a first density and viscosity and being in contact with a second fluid medium adjacent the vehicle. The second fluid medium has a second fluid density which is different from the first fluid density. The lift producing device comprises opposed first and second major surfaces joined at a longitudinally extending leading edge and at a longitudinally extending trailing edge, with at least a portion of the longitudinally extending leading edge being spaced from the longitudinally extending trailing edge by a predetermined mean chord length. When the vehicle is moved relative to the first fluid medium at a velocity within a range of predetermined velocities, with each of the velocities having a direction inclined from a plane extending through the leading edge and the trailing edge within a predetermined angular range, a region of high pressure is generated in the first fluid medium adjacent the first major surface and a region of low pressure is generated in the first fluid medium adjacent the second major surface. The lift producing device has a cross-sectional shape which will generate a pressure distribution around the device when the vehicle is moved relative to the first fluid medium at a velocity within the range of predetermined velocities such that the first fluid medium exhibits attached laminar flow along the device for a portion of the predetermined mean chord length from the leading edge to the trailing edge and will neither form a laminar separation bubble adjacent the second major surface of the device, nor exhibit turbulent separation adjacent the second major surface for substantially all of the predetermined mean chord length from the leading edge to the trailing edge. The portion along which attached laminar flow is maintained is the longest portion which will still fulfill the flow separation requirements. A method for producing the foil is also disclosed.

10 Claims, 8 Drawing Sheets

LIFT PRODUCING DEVICE EXHIBITING LOW DRAG AND REDUCED VENTILATION POTENTIAL AND METHOD FOR PRODUCING THE SAME

STATEMENT OF GOVERNMENT RIGHTS

This invention was made with Government support under Contract NCCI-24 awarded by NASA. The Government has certain rights in this invention.

BACKGROUND OF THE INVENTION

The present invention relates to a lift producing device, such as a "skeg," adapted to be connected to a vehicle, such as a sailboard or sailboat, to provide lift, e.g., lateral lift, to said vehicle when moved relative to a fluid medium such as water, and to a method for producing such a device.

Vehicles such as sailboats and sailboards have a lift producing device which extends from the bottom of the hull and which is used to counterbalance the lateral sail force.

In high performance sailboards, the lift producing device is in the form of a small skeg attached to the bottom rear of the hull. The skeg is used to generate a force to counterbalance the lateral sail force. Centerboards are not used on these small high performance sailboards. When the sailboard is underway, the skeg commonly experiences a sudden loss of lateral lift. The remaining unbalanced sail force causes the rear of the hull to slide sideways. Sailors call this phenomenon "spinout."

Boardsailing has evolved to the upper ranks of high performance sailing. A new world record for waterborne sailcraft was established in 1988 by a sailboard sailed at 40.30 knots. The new world record was possible because of a major refinement in equipment design and construction. Not only have the top boardsailors benefitted from this refined technology, but the recreational boardsailing community has shifted to high performance boardsailing. The equipment trend is characterized by short hull length and high aspect ratio sails. The hulls, commonly called short boards, are intended for planing conditions only, thus requiring wind velocities in excess of 15 knots. Since speed is the cure for the insatiable quest, short boards are sailed on the fastest points of sail. FIG. 1 illustrates the common points of sail in relation to the true wind 2. The broad reach 4 and beam reach 6 are the faster points of sail. The close reach 8 is necessary in order to return to the launching location after sailing on broad a reach 4.

The off-the-wind points of sail and short waterline length of these planing hulls dictate only a skeg near the stern be used to counterbalance the lateral sail force. FIGS. 2A and 2B illustrate the lateral forces involved. The sailboard shown in FIGS. 2A and 2B has hull 10 shown on water surface 20, mast 12 connected to the upper surface of hull 10, sail 14 having pressure center 16 connected to mast 12, and skeg 18 connected to the lower surface of hull 10. As sail and hull design improve, greater performance is demanded from the skeg. The increased skeg loading causes them to spin out, frustrating many sailors. The spinout phenomenon is characterized by the sudden loss of skeg lateral lift. The remaining unbalanced lateral sail force causes a rapid increase in hull leeway angle and velocity decrease.

At one time or another, the boardsailing community has blamed spinout on cavitation, ventilation and stall.

In order to determine the cause of sailboard spinout, the skeg function and its operating environment must be clarified. As mentioned previously, the skeg is used to counterbalance the lateral force generated by the sail. The lateral force developed by the skeg, called "lift" herein, is a function of the hull velocity, the skeg area and the hull leeway angle The leeway angle is equivalent to the skeg angle of attack. These parameters are related by equation (1):

$$L=(\tfrac{1}{2})\rho V^2 S\, C_L \qquad (1)$$

where the symbols used in equation (1) and other symbols used hereinafter are defined as follows:

SYMBOLS a skeg lift curve slope, per degree
$a_e$ skeg section lift curve slope, per degree
AR skeg aspect ratio, $(2b)^2/2S$
b skeg semispan, in.
c skeg section chord, in.
$\bar{c}$ mean skeg chord, S/b, in.
$c_d$ skeg section drag coefficient, profile drag/$q_\infty S$
$C_L$ skeg lift coefficient, skeg lift/$q_\infty S$
$c_l$ skeg section lift coefficient, section lift/$q_\infty S$
$C_P$ pressure coefficient, $(P-P_\infty)/q_\infty$
f correction factor of 3D lift curve slope
$H_{32}$ boundary layer shape factor, energy thickness $(\delta_3)$/momentum thickness $(\delta_2)$
kt nautical miles per hour
L skeg lift, $q_\infty SCL$
P static pressure, $lbf/ft^2$
q dynamic pressure, $(\tfrac{1}{2})\rho V^2$, $lbf/ft^2$
R mean chord Reynolds number, $\rho V\bar{c}/\mu$
S skeg area, $in.^2$
u tangential velocity component within boundary layer, ft/s
U potential flow velocity, ft/s
V hull velocity, ft/s
x length in streamwise direction tangential to surface in the boundary layer method, ft.
X skeg section abscissa, in.
y length normal to surface in the boundary layer method, ft.
Y skeg section ordinate, in.
$\rho$ water density, $slugs/ft^3$
$\sigma$ cavitation number $(P_{amb}-P_{vap})/q_\infty$
$\mu$ water viscosity, slugs/ft.s Subscripts:
amb ambient
atm atmospheric
incpt cavitation inception
min minimum
vap water vapor
$\infty$ free-stream conditions.

The lift coefficient is directly proportional to the leeway angle. For a given skeg area and hull velocity, the leeway angle will increase until the skeg produces a force of equal value to the lateral sail force. It is assumed the lateral resistance of the hull has a negligible effect in opposing the sail force for off-the-wind sailing.

The different hull velocities and sail trim angles for the three main points of sail result in three different leeway angles. For a given skeg, these leeway angles along with the hull velocities define the skeg operating lift coefficients and Reynolds numbers. By observing the operating conditions at spinout, the lift coefficients and Reynolds numbers during spinout ca be determined. From the skeg section geometry, the pressure distributions can be obtained for the required flow angles. With this data, the culprit causing spinout can be pinpointed.

The two flow parameters defining the skeg operating environment are hull velocity and leeway angle. FIG. 3 illustrates a test hull 10 constructed incorporating a flow vane 22 extending ¼ semispan past the tip of the skeg 18. As indicated in FIG. 3, the upper end of the vane axis exits through the deck of the hull 10. At this end, a mechanical multiplier 24 and pointer 26 are connected to the shaft 28. The multiplier 24 results in approximately ½ inch of pointer movement along scale 30 per degree of vane movement. The flow vane 22 was calibrated using the hull centerline as the zero degree reference. This reference coincides with the skeg zero lift angle.

The tests were conducted at both ends of the wind velocity spectrum. For these tests, sail sizes were used which match the wind strength. Wind velocities in the 15 to 20 knot range required a 7.5 sq. meter sail. Wind velocities of 25 to 30 knots demanded a 4.6 sq. meter sail. Improper sail size selections were considered irrelevant and, therefore, were not tested. Water surface conditions varied from 2 to 18 inch wind chop.

The results of the leeway angle measurements for the three points of sail are summarized in Table 1. The angle range represents the extremes of pointer movement caused by the audible vortex shedding off the vane shaft 28. The additional drag caused by the flow vane 22 made the test hull leeway angles greater than the actual values. However, the flow vane drag caused the angles to increase less than one degree. Since the error is on the conservative side, the leeway angle measurement inaccuracies are acceptable. The angle measurements were repeatable for each point o sail regardless of the wind conditions.

The hull velocity ranges for each point of sail are also contained in Table 1. These hull velocities were determined from time and distance measurements without the flow vane 22 installed.

The geometry from the test skeg can be used to determine the skeg lift curve slope. The lift curve slope per degree for the skeg is given by equation (2) as discussed in Abbott, I. H. and von Doenhoff, A. E.: The Significance of Wing-Section Characteristics, *Theory of Wing Sections;* 1st ed., McGraw-Hill, New York, 1949, pp. 11–16.

$$a = f\left[\frac{a_e}{1 + \left(\frac{57.3\, a_e}{\pi\, AR}\right)}\right]. \tag{2}$$

The measured leeway angles are multiplied by the skeg lift curve slope to determine the skeg lift coefficients for the three points of sail. The lift coefficients corresponding to their respective leeway angles are listed in Table 1. The lift coefficients for the skeg are the same when transformed into two-dimensional section data. The data, coupled with the chord Reynolds numbers of Table 1, are the key to solving the sailboard spinout problem.

TABLE 1

| Points of Sail | Broad Reach | Beam Reach | Close Reach |
|---|---|---|---|
| Leeway angle, degree | 2 to 3 | 4 to 5 | 7 to 8 |
| Skeg lift coefficient | 0.16 to 0.23 | 0.31 to 0.39 | 0.54 to 0.62 |
| Mean lift coefficient | 0.19 | 0.35 | 0.58 |
| Hull velocity, kt | 20 to 30 | 17 to 23 | 10 to 16 |
| Mean hull velocity, kt | 25 | 20 | 13 |
| Mean Reynolds number | 1,513,000 | 1,210,000 | 787,000 |

Spinout has been observed to occur only sailing close and beam reaches. The phenomenon is intermittent, i.e., only occurring occasionally at a given point of sail and hull velocity. This information narrows the possibilities to cavitation and ventilation. Stall is ruled out because the maximum lift coefficient for the test skeg, $C_L = 0.94$, is not reached while sailing on either a close or beam reach.

Cavitation probability can be examined from the plot of lift coefficient versus cavitation inception velocity for several common skeg sections. The cavitation inception velocity is based on the instant when a point on the section reaches the vapor pressure of water. Cavitation requires a certain time and length on the foil section with pressure at or below the water vapor pressure before cavitation occurs as explained in Hoerner, S. F.: Hydrodynamic Drag, *Fluid-Dynamic Drag,* 2nd ed., published by the author, New York, 1965, pp. 10–6, 10–7. Therefore, the plots in FIG. 4, which are plots of skeg section lift coefficient versus cavitation inception velocity, are conservative. The skeg sections plotted in FIG. 4 are the NACA (National Advisory Committee for Aeronautics) 63A012, 0012 and two sections measured from a "White Lite" production skeg, available from Windsurfing Hawaii of Coleta, California, which I have designated WSKG21S and WSKG22S. The minimum pressure coefficients for the plotted sections were obtained from the Eppler program which is described in Eppler, R. and Somers, D. M.: A Computer Program for the Design and Analysis of Low-Speed Airfoils, NASA TM 80210, 1980, the contents of which are incorporated herein by reference. This program calculates the inviscid pressure distribution from the given section geometry using a higher-order panel method. The minimum pressure coefficients for the various lift coefficients are used in equation (3) to calculate the cavitation inception velocities.

$$V_{incpt} = \left[\frac{2(P_{amb} - P_{vap})}{\rho\,|Cp_{min}|}\right]^{\frac{1}{2}}. \tag{3}$$

The ambient pressure $P_{amb}$, is taken as the worst case, which is the local atmospheric pressure.

As seen in FIG. 4, the curve for the 63A012 section used on the test skeg does not fall into the close or beam reach operating regions This fact, along with the conservatism built into the plots, clears cavitation as the cause of spinout Nevertheless, cavitation must be considered in skeg section design.

With cavitation and stall eliminated from the possibilities, ventilation is considered Ventilation is the entrance of air from the atmosphere into the low-pressure area of the skeg. This causes a sudden loss of lift because the relatively high atmospheric air pressure replaces the low pressure previously generated by the skeg. Several studies of ventilation indicate separation, forming a region of low momentum space with sub-ambient pressures, is a prerequisite for ventilation. See, e.g., Breslin, J. P. and Skalak, R.: Exploratory Study of Ventilated Flows About Yawed Surface-Piercing Struts, NASA MEMO 2-23-59W, April 1959, Washington, D.C.; Hoerner, S. F.: Some Characteristics of Spray and Ventilation, Hydrofoil Research Project, Tech. Report No. 15, Sept. 1953, Navy Dept., Washington, D.C.; and Wadlin, K. L.: Mechanics of Ventilation Inception, Second Symposium on Naval Hydrodynamics, August 1958, Washington, D.C. The other necessary factor for ventilation is a connection between the atmosphere and the separated region.

These facts, along with the skeg operating lift coefficients and Reynolds numbers at spinout, indicate ventilation is the cause of spinout The lift coefficients and Reynolds numbers for the operating conditions prone to spinout vary from 0.31 to 0.62 and 1,330,000 to 600,000. These lift coefficients are great enough to require pressures significantly below atmospheric pressure. The boundary layer separation required for ventilation is a difficult phenomenon to predict. The Reynolds number range indicates a laminar boundary layer would exist over portions of a section with favorable or even very mild adverse pressure gradients. If these sections were improperly designed, laminar separation would occur before transition to turbulent flow. At the moderate angles involved, separated laminar flow normally transitions in the free shear layer and the resulting turbulent flow reattaches The resultant separated region is called a laminar separation bubble. The laminar separation bubble would then provide the necessary low pressure, low energy space for the air to displace.

The skeg is located underneath and forward one to two chord lengths from the stern of the sailboard. For ventilation to occur, air must reach the separated region on the low pressure surface. Intermittent pockets of air pass underneath the hull as it planes over the choppy water surface. This air represents a constant pressure boundary, maintaining attached flow near the skeg root because of the lack of an adverse pressure gradient. When the hull is operating without the presence of air pockets, the pressure gradient at the base of the skeg is slightly favorable. This is due to the pressure relief of the planing hull as the hull stern is approached. Again, this would promote attached flow near the skeg root. The turbulent boundary layer of the hull also prevents any possibility of laminar separation at the skeg root. Then how does air get into the separated region?

The answer to the question has been demonstrated in yawed surface-piercing strut tests at two research facilities. See, e.g., Breslin, J. P. and Skalak, R.: Exploratory Study of Ventilated Flows About Yawed Surface-Piercing Struts, NASA MEMO 2-23-59W, April 1959, Washington, D.C.; and Wadlin, K. L.: Mechanics of Ventilation Inception, Second Symposium on Naval Hydrodynamics, August 1958, Washington, D.C. Oil flow studies indicate a laminar separation bubble near mid-chord. The free surface effect maintains an attached flow for approximately 1/10 chord distance down the span. This attached flow prevented the separated region from ventilating. As soon as the water surface was disturbed near the leading edge, the separated region ventilated. For the model tests, this disturbance was caused by tapping the water surface ahead of the leading edge with a yardstick. As for the sailboard, this disturbance is caused by the hull slapping the water surface as it planes over the chop. These perturbations cause any separated region near the skeg root to ventilate.

This phenomenon explains why the sailboard spins out intermittently while sailing at a constant point of sail and hull velocity. If cavitation or stall were the culprits, spinout would occur every time the critical leeway angle and hull velocity were reached. Ventilation coincides with spinout.

Skeg manufacturers have developed several device aimed at preventing skeg ventilation. These devices follow two lines of thought. The first is aimed at preventing the air from reaching the laminar separation bubble on the skeg. The second seeks to maintain attached flow by causing turbulent flow to strike the main portion of the skeg at a reduced angle of attack.

The prevention of air from reaching an separated region is accomplished by four common techniques. The first, shown in FIG. 5A, employs a cutout 32 in the planform of the skeg 18 in the trailing edge at the skeg root. This places most of the skeg area further down in the water away from the air source. The second technique, shown in FIG. 5B, uses a small canard 34 or "forefin" in front of the main skeg root area. The forefin 34 extends from the base of the hull 10 to approximately ¼ semispan. The turbulent wake off the forefin 34 strikes the main skeg 18 at a reduced angle of attack. The turbulent flow precludes the possibility of laminar separation on the main skeg 18. The induced angle of attack of the flow striking the main skeg 18 is less than the hull leeway angle. This further supports attached flow on the main skeg 18 in the area behind the forefin 34. This attached flow near the root helps to block the air from reaching any separated region further down the span. A third method, not shown in the drawings, uses an abrupt change in planform shape such as a bump on the leading edge near the root. This planform change causes a vortex to trail along the low pressure side of the skeg, acting as a hydrodynamic fence to block the air from reaching the outer portion of the span. A vortex off the tip of a forefin has the same effect. The last method, which is used for blocking the movement of air down the span of the skeg, involves physical fences 36 attached to the skeg 18 at several spanwise locations, as shown in FIG. 5C.

Another method previously employed to prevent spinout is an extension of the forefin idea in which the skeg 18 has a slot 38 extending to half or more of the skeg semispan, as shown in FIG. 6A. Tandem or "split" skegs, which have a full span slot 38' separating the split portions **18*a* and 18*b*, as shown in FIG. 6B, represent the extreme. The foil 18*a* ahead of the main skeg 18*b* induces a lower angle of attack as the water flows past the leading foil 18*a*. The turbulent flow at a lower angle of attack on the main skeg body 18*b* reduces or eliminates flow separation over the normal operating range of the skeg 18**.

When the NACA 0012 section is used for a sailboard skeg, it can, if accurately reproduced, provide a short length of attached laminar flow and prevent separation over a certain operating range. However, the attached laminar flow is not long enough to provide low drag.

The problem with all of the existing methods of ventilation prevention is the higher drag associated with the generation of a vortex or turbulent flow. Since low drag is a requisite for speed, another approach is sought for the avoidance of skeg ventilation.

SUMMARY OF THE INVENTION

The present invention solves the ventilation problem with respect to lift producing devices, e.g., skegs for use on sailboards, sailboats and other vehicles while maintaining low drag by providing a lift producing device which is adapted to be connected to a vehicle to provide lift to the vehicle when the vehicle is moved relative to a first fluid medium having a first density and viscosity and being in contact with a second fluid medium adjacent the vehicle. The second fluid medium has a second fluid density which is different from the first fluid density. The lift producing device comprises opposed first and second major surfaces joined at a longitudinally extending leading edge and at a longitudinally extending trailing edge, with at least a portion of the longitudinally extending leading edge being spaced from the longitudinally extending trailing edge by a predetermined mean chord length. When the vehicle is moved relative to the first fluid medium at a velocity within a range of predetermined velocities, with each of the velocities having a direction inclined from a plane extending through the leading edge and the trailing edge within a predetermined angular range, a region of high pressure is generated in the first fluid medium adjacent the first major surface and a region of low pressure is generated in the first fluid medium adjacent the second major surface. The lift producing device has a cross-sectional shape which will generate a pressure distribution around the lift producing device when the vehicle is moved relative to the first fluid medium at a velocity within the range of predetermined velocities such that the first fluid medium exhibits attached laminar flow along the lift producing device for a portion of the predetermined mean chord length from the leading edge to the trailing edge and will not form a laminar separation bubble adjacent the second major surface of the lift producing device.

The lift producing device is produced by providing a material which is capable of being shaped, specifying the predetermined mean chord length of the lift producing device and determining the range of predetermined velocities and the predetermined angular range. Based on the predetermined mean chord length, the range of predetermined velocities, the predetermined angular range, the first density and the viscosity of the first fluid medium, at least one of a pressure distribution and a velocity distribution along said predetermined mean chord length is determined such that the first fluid medium will exhibit attached laminar flow along the lift producing device for a portion of the predetermined mean chord length from the leading edge toward the trailing edge and will not form a laminar separation bubble adjacent the second major surface of the lift producing device. A cross-sectional shape is calculated which will generate at least one of pressure distribution and velocity distribution when the vehicle is moved relative to the first fluid medium at a velocity within the range of predetermined velocities. The lift producing device is then shaped so as to have the predetermined mean chord length and the cross-sectional shape.

Instead of blocking air or creating turbulent flow, the foil section is designed for attached laminar flow which avoids ventilation while maintaining low drag because of the lack of a laminar separation bubble on the low pressure surface. The low skin friction of a laminar boundary layer will keep the drag low. Designing the pressure distribution about the foil section for the foil's operating conditions such that the adverse pressure gradients are mild enough would ensure long lengths of laminar flow. Inducing turbulent flow just as the boundary layer reaches the more adverse pressure at the beginning of the main pressure recovery region will maintain an attached boundary layer through the pressure recovery region. Designing a proper foil section for, e.g., the sailboard skeg, with the intention of maintaining long lengths of attached laminar flow will maintain low drag while preventing ventilation.

DESCRIPTION OF THE PREFERRED EMBODIMENT

Solving the problem directly, a foil or skeg section designed for attached laminar flow avoids spinout while maintaining low drag. This skeg section is designed utilizing in part the conformal-mapping method contained in the Eppler program. This method computes the foil section shape from specified properties of the potential flow velocity (or pressure) distribution. An approximative boundary layer computation method is used for calculating the boundary layer flow from the potential flow velocity distribution. The section lift and drag are calculated from the boundary layer and potential flow velocity distribution.

The Eppler program also displays the state of the boundary layer for the various lift coefficients and Reynolds numbers. These boundary layer developments indicate where the boundary layer is laminar in a favorable pressure gradient, laminar in an adverse pressure gradient, laminar at or near separation, transition to turbulent flow and whether turbulent separation is present for the specified design conditions.

Figure 12:
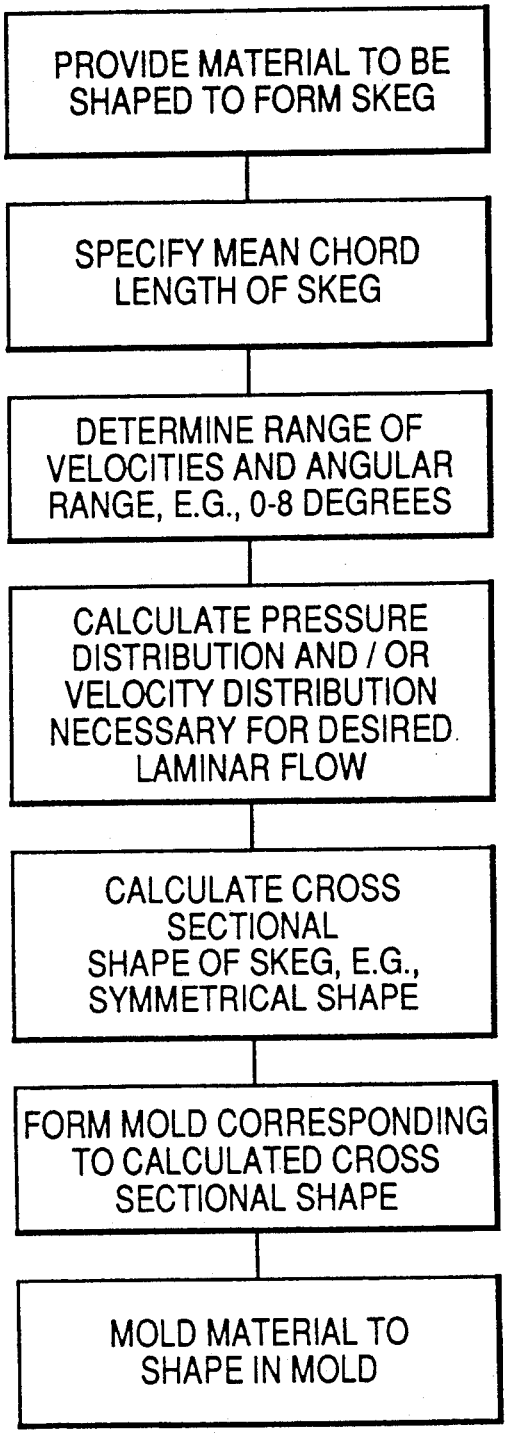
FIG. 12 is a block diagram showing the method steps of the present invention.

The present invention is useful in connection with any vehicle having a lift producing device where ventilation is a problem. Referring generally to FIG. 12, the following description of the preferred embodiment is made in connection with a sailboard skeg; however, the present invention is not limited thereto.

The data gathered during the hull leeway angle and velocity measurement tests have been used as the design conditions for a skeg section generated using the Eppler program. The mean values of lift coefficients for the three points of sail set part of the information required for an outline of the required drag polar. To complete the desired drag polar, a drag coefficient was chosen which would result in ½ pound lower drag at the design points than would a skeg of similar area and planform incorporating the NACA 0012 section.

The skeg used to set the design criteria had a planform area of 45 sq. inches, a semispan of 11 inches and a mean chord length of 4.1 inches. This chord length, used in conjunction with the mean hull velocities, define the design Reynolds numbers for the three design lift coefficients. The design points and Reynolds numbers are listed in Table 2.

TABLE 2

| Points of Sail | Broad Reach | Beam Reach | Close Reach |
|---|---|---|---|
| Design lift coefficient | 0.19 | 0.35 | 0.58 |
| Design drag coefficient | 0.0056 | 0.0057 | 0.0073 |
| Mean Reynolds number | 1,440,000 | 1,150,000 | 750,000 |

Other criteria for the skeg section design include no separation throughout the operating range. For conservatism against separation, the section will be required not to have laminar separation bubbles at ⅓ of the design Reynolds numbers. In order to achieve docile performance change as the leeway angle is increased, the polar will have a rounded corner at the outer edge of the low drag bucket Cavitation should be avoided by maintaining the minimum pressure higher than the water vapor pressure. The maximum lift coefficient should be higher than 0.62, which will avoid turbulent separation problems within the skeg operating range. A symmetrical section is used because the sailboard preferably operates on both port and starboard tacks.

The flow around the leading edge is designed to be laminar To meet the low drag requirement, a long length of laminar flow is required While there is no predetermined minimum percentage of the chord length along which the flow must be laminar, the longer the attached laminar flow, the lower the drag. Thus, the optimum section shape is designed for the longest possible length of attached laminar flow while still allowing enough distance for pressure recovery such that there is no separated flow on the low pressure side. Of course, attached laminar flow for lengths somewhat shorter but approximately equal to this longest possible length are acceptable, but result in slightly higher drag. Laminar flow can be maintained under favorable or zero pressure gradients provided the surface of the lift producing device is smooth. The skeg's Reynolds numbers are low enough which will maintain laminar boundary layer stability through even mild adverse pressure gradients.

A fresh turbulent boundary layer can remain attached through a more adverse pressure gradient than a laminar boundary layer. The energy level is much higher within the turbulent boundary layer just after transition when compared to the laminar case right before transition. This increased energy level enables the turbulent layer to remain attached through more adverse pressure gradients.

The pressure must rise to the ambient level as the trailing edge is approached. The aft section of the velocity distribution is reserved for this pressure recovery. A small region aft of the main pressure recovery region is the closure contribution, which is required to obtain a closed section shape. The mild, low pressure gradient over the forward portion of the foil cannot extend too far aft or else the adverse pressure gradient within the pressure recovery region will be too severe and separation will occur.

With this in consideration, the pressure distributions are specified with mild adverse pressure gradients extending as far aft as possible along the chord while still meeting the separation criterion. The laminar boundary layer never feels the strong pressure rise over the aft portion of the foil because turbulent flow is induced just before the very adverse pressure gradient is reached. The skeg section pressure distributions have incorporated an instability region or "transition ramp" which contains pressure gradients strong enough to induce transition, but not so strong as to cause laminar separation. See, e.g., Wortmann, F. X.: Progress In The Design Of Low Drag Airfoils, *Boundary Layer And Flow Control*, Pergamon Press, London, 1961, pp. 748–770. These transition ramps keep the boundary layer attached by energizing the boundary layer with turbulent flow just before the rapid pressure rise. The transition ramp has been carefully designed to keep the transition region on the transition ramp when the skeg section is operated over the beam and the broad reach. Due to the different angles of attack at these points of sail, a cambered transition ramp has been utilized. See, e.g., Eppler, R. and Somers, D. M.: Airfoil Design for Reynolds Numbers Between 50,000 and 500,000, *Proceedings of the Conference on Low Reynolds Number Airfoil Aerodynamics*, University of Notre Dame UNDAS-CP-77B123, June 1985, pp. 1–14. The cambered transition ramp avoids the rapid transition location jump to the front of the ramp and subsequent laminar separation as in the linear ramp case.

The boundary layer specified can be analyzed in terms of its potential flow velocity (U) where:

$$U(x) = \lim_{y \to \infty} u(x,y). \tag{4}$$

The momentum thickness of the boundary layer is $$\delta_2(x) = \int_0^\infty \left(1 - \frac{u}{U}\right)\frac{u}{U}\,dy \tag{5}$$

and the energy thickness is $$\delta_3(x) = \int_0^\infty \left[1 - \left(\frac{u}{U}\right)^2\right]\frac{u}{U}\,dy. \tag{6}$$

The shape factor $H_{32}$ is then $$H_{32} = \frac{\delta_3}{\delta_2}. \tag{7}$$

If $H_{32} \geqq 1.57258$, the tangential velocity component u(y) has no inflection point. Conversely, when $H_{32} < 1.57258$, u(y) has an inflection point. Laminar separation is seen when $H_{32} \leqq 1.51509$. Turbulent separation is assumed when $H_{32} \leqq 1.46$. See, e.g., Eppler et al, "A Computer Program for the Design and Analysis of Low Speed Airfoils," NASA TM 80210, 1980. Accordingly, the potential flow velocity distribution and/or pressure distribution is specified so that the laminar boundary layer shape factor, $H_{32}$, is greater than 1.51509 to avoid laminar separation.

Figure 1:
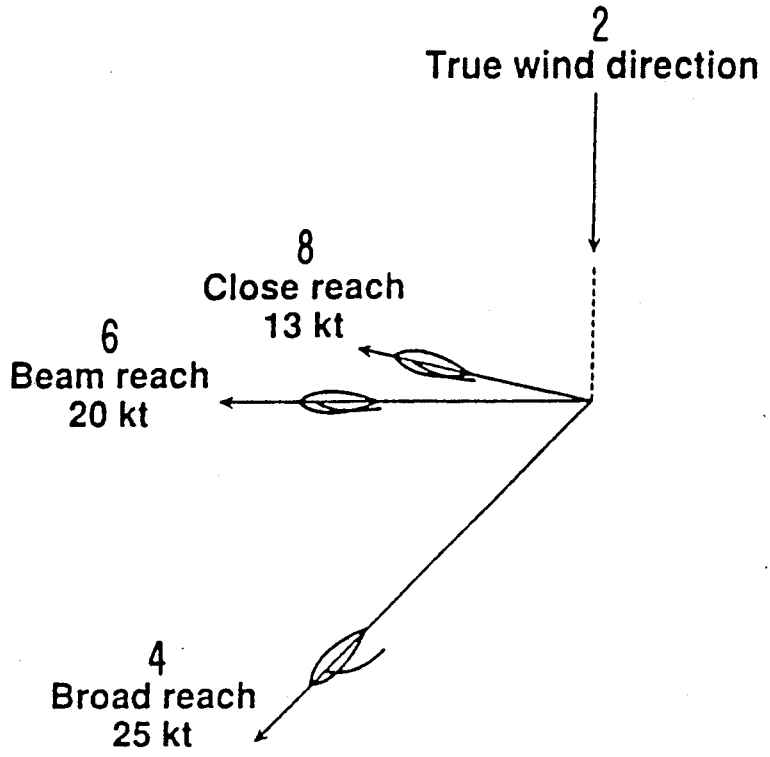
FIG. 1 is a sketch of the common points of sail in relation to the true wind.
Figure 3:
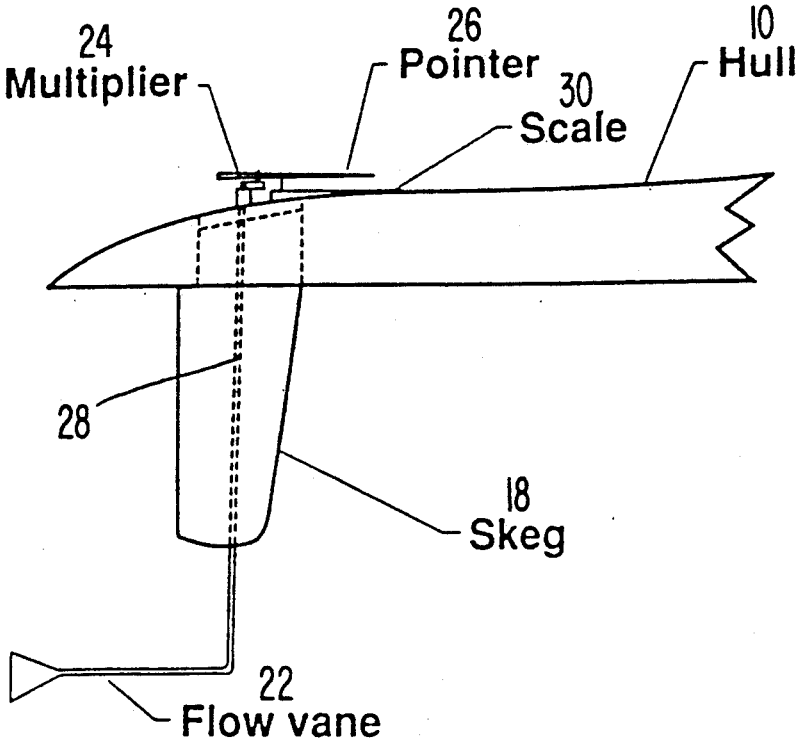
FIG. 3 is a side perspective view of a test hull constructed to determine the cause of spinout.
Figure 2A:
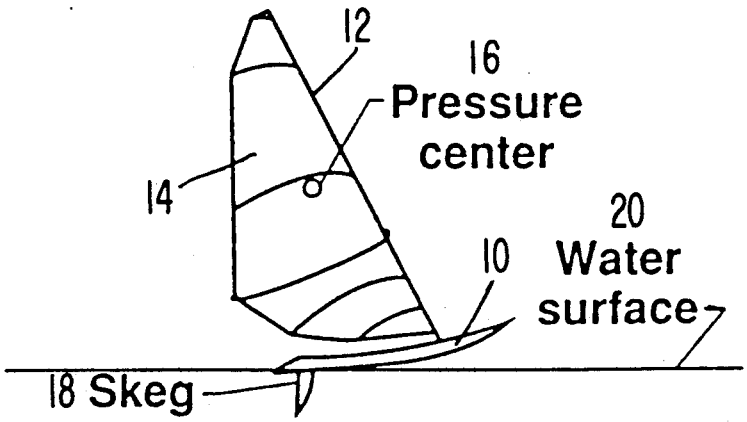
FIG. 2A is a side view of a vehicle such as a sailboard.
Figure 2B:
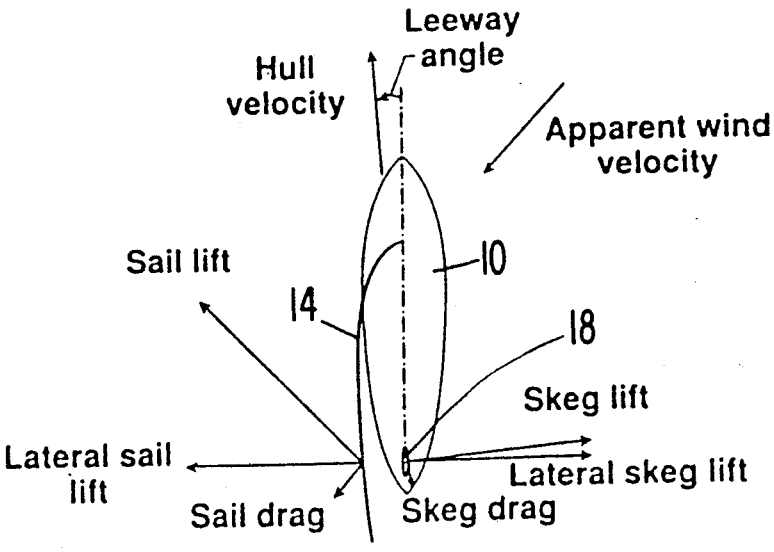
FIG. 2B is a plan view of the sailboard shown in FIG. 2A, illustrating the lateral forces acting on the sailboard.
Figure 4:
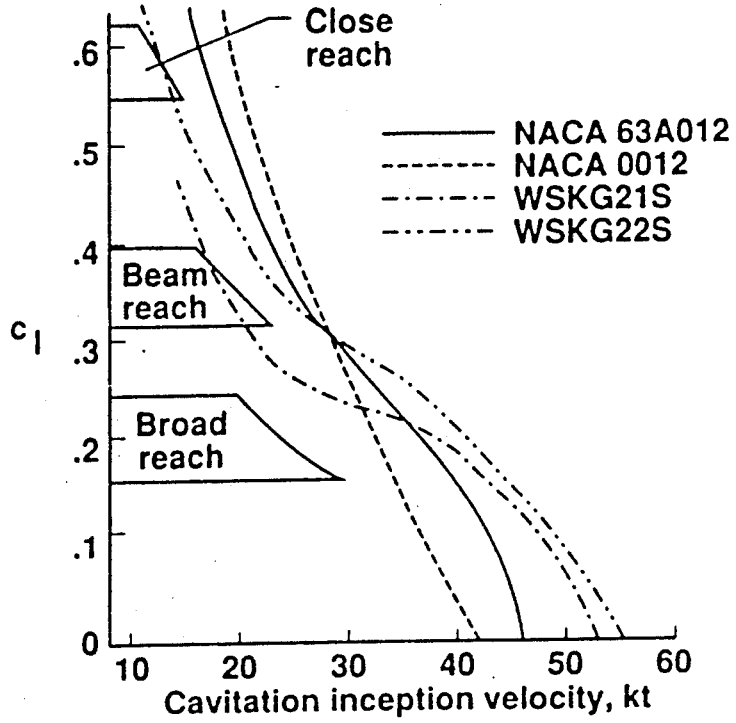
FIG. 4 is a graph of skeg section lift coefficient versus cavitation inception velocity.
Figure 7:
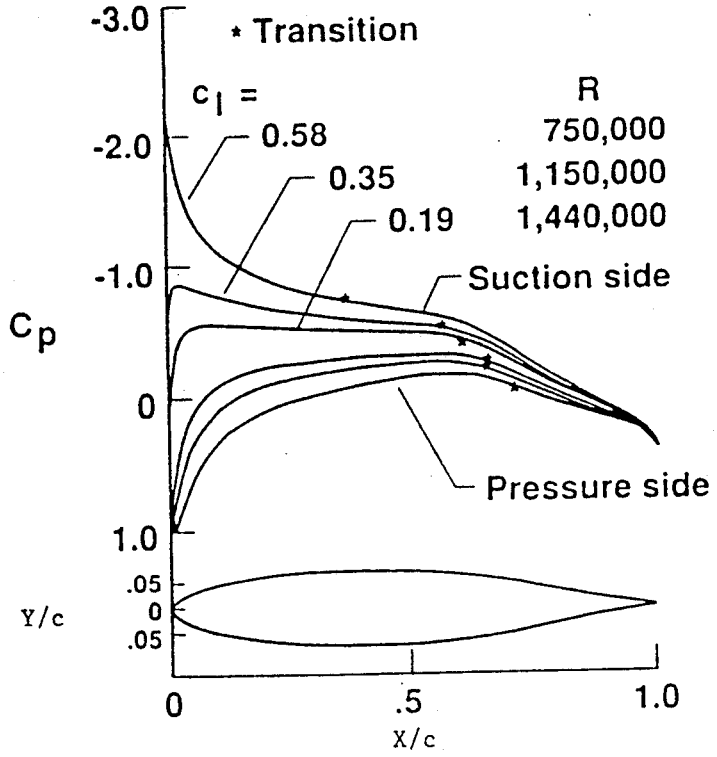
FIG. 7 is a graph of pressure distribution corresponding to lift coefficients and of foil thickness divided by chord length versus fraction of chord length.
Figure 5C:
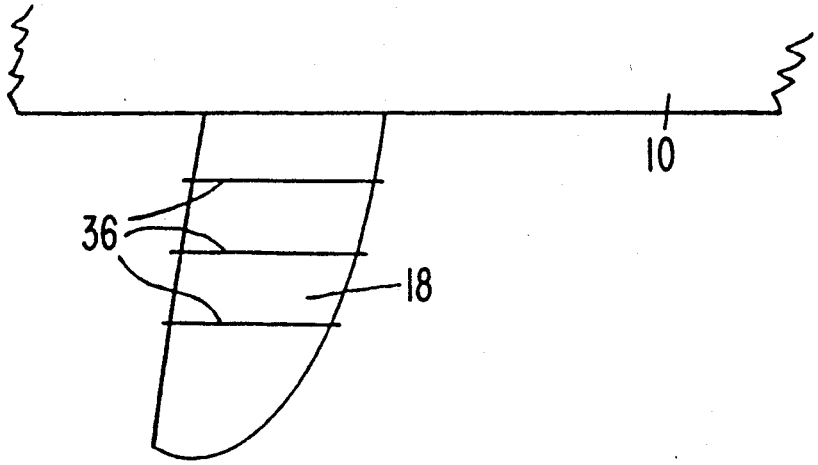
FIGS. 5A-5C are side perspective views of skegs designed to prevent ventilation.
Figure 5B:
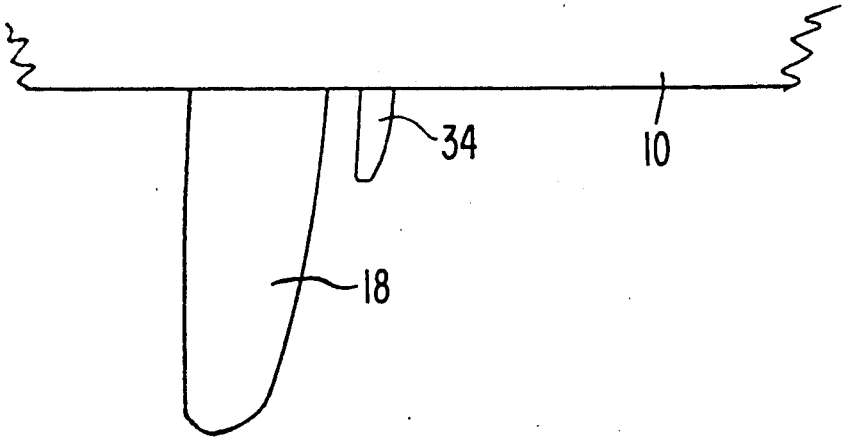
Figure 5A:
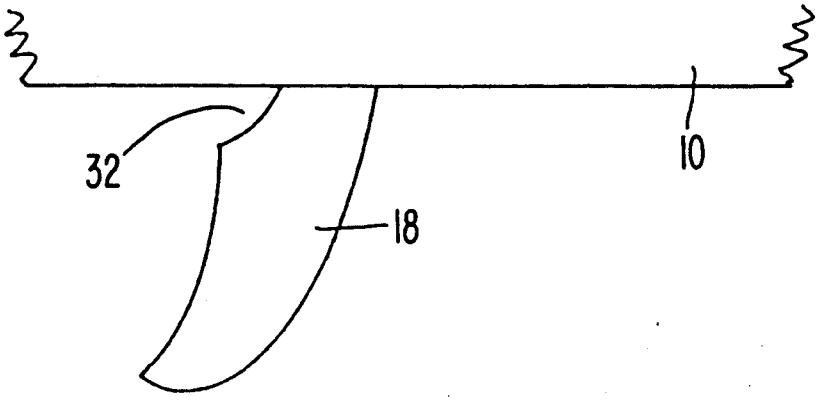
Figure 6A:
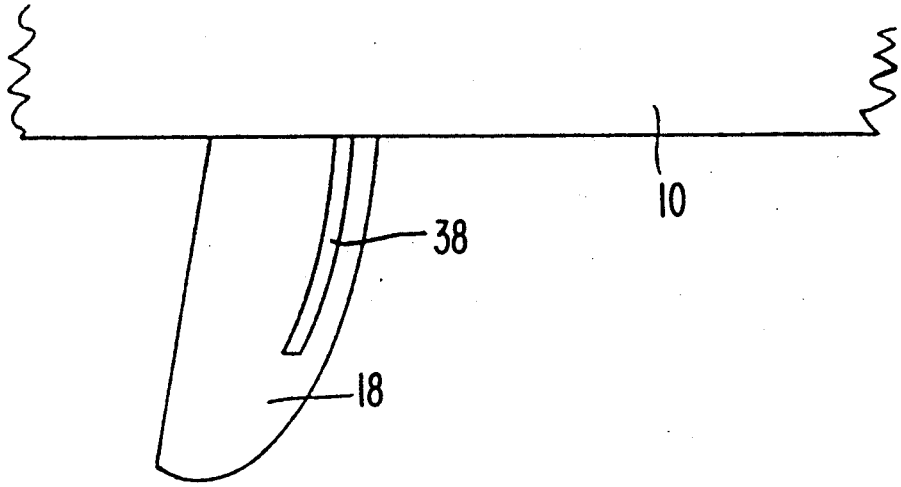
FIGS. 6A and 6B are side perspective views of skegs having slots designed to prevent ventilation.
Figure 6B:
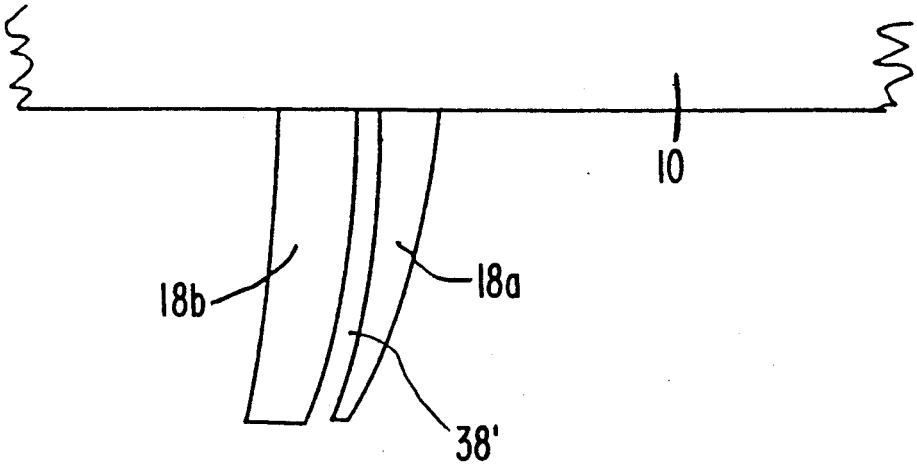

The specified pressure distributions for the three design lift coefficients are presented in FIG. 7. The cambered transition ramp, the main pressure recovery region and closure contribution are readily distinguished. The transition locations for their respective lift coefficients and Reynolds numbers are indicated on the pressure distributions.

The specified pressure distributions result in a 14.5% thick section, designated the RACE 145. This section is plotted underneath the pressure distributions in FIG. 7. Laminar and turbulent separation for the RACE 145 can be checked by observing the boundary layer development for the design lift coefficients and Reynolds numbers.

Laminar separation is avoided for all three of the design points. Turbulent separation can be observed for the two upper lift coefficient design points, but does not occur for substantially all of the chord length from the leading edge to the trailing edge. That is, turbulent separation occurs just as the trailing edge is approached when the section is operating at the middle lift coefficient design point. At the upper lift coefficient design point, turbulent separation occurs 2% of the chord ahead of the trailing edge. This separation violates part of the design criteria, but the region is near ambient pressure and small enough to assume ventilation will not be a problem.

Figure 8:
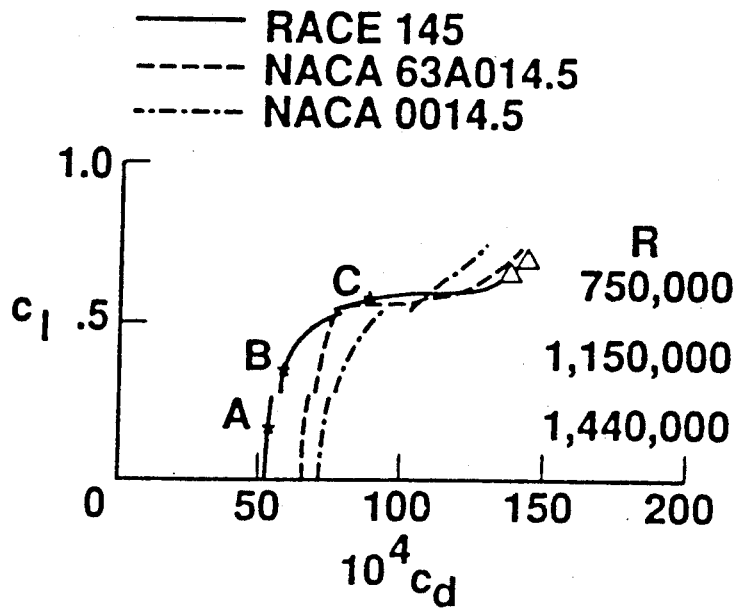
FIGS. 8-10 are graphs of skeg section lift coefficients versus skeg section drag coefficients at the indicated Reynolds numbers.

The drag polar for the RACE 145 is compared with two NACA four-digit and six series sections of equal thickness in FIG. 8. The NACA six series section of 14.5% thickness was generated by the Eppler program by multiplying the coordinates of the 63A015 section by an appropriate thickness factor, forming a section designated as the 63A014.5. The three Reynolds numbers which correspond to the three points of sail influence the drag polar, causing distinct breaks with the change in Reynolds number. The low drag bucket is 17% deeper and 5% wider when compared to the NACA 63A014.5 at design points A and C, respectively. Comparing the RACE 145 to the NACA 0014.5 section, profile drag decreases of 27%, 29% and 17% are realized at the design points A, B and C, respectively. These are significant improvements over the existing NACA four-digit and six series sections of equal thicknesses.

F. X. Wortmann states that by proper specification of the velocity distribution, an increase of the low drag bucket depth or an increase of the drag bucket width approximately equal to the section thickness is obtainable compared to a NACA six series section of equal thickness. See, e.g., Wortmann, F. X.: Progress In The Design Of Low Drag Airfoils, *Boundary Layer And Flow Control,* Pergamon Press, London, 1961, pp. 748–770. As indicated from FIG. 8, the RACE 145 exceeds Wortmann's expectations.

Figure 9:
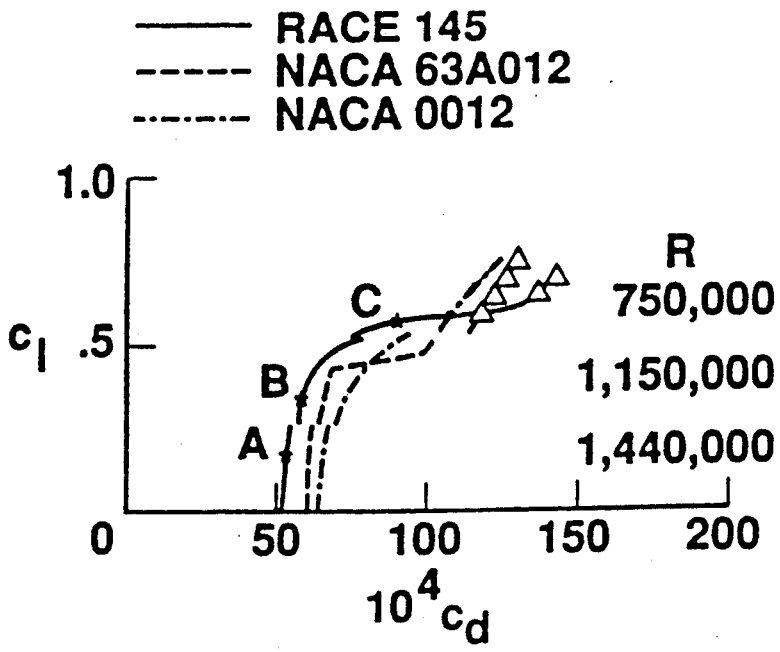

The NACA 0012 and the 63A012 section polars are plotted with the RACE 145 polar in FIG. 9. These two NACA sections are presently used on some production sailboard skegs. The design criteria in Table 2 list the profile drag coefficients which are required to obtain ½ pound lower drag at the three design points for a skeg of equal area and planform. Comparing the sections in FIG. 9 with the requirements in Table 2, point A has more than a ½ pound drag decrease. The beam reach design point B is equal to the ½ pound decrease, while the close reach point C does not meet the requirement. The close reach case is considered acceptable for several reasons. The profile drag is lower than the existing NACA symmetrical sections at this point by at least 17%. The close reach is not a fast point of sail because the sailboard is working its way up into the wind. Nevertheless, the 17% plus decrease in drag will certainly help the sailboard. The ½ pound lower drag requirement is not considered as important for this point of sail because the majority of short boardsailing is done off-the-wind.

An attached boundary layer for the normal skeg operating range is of equal importance as the low drag requirements. The RACE 145 has been designed to avoid laminar separation by using the mathematical laminar separation bubble model contained in the Eppler program. The Eppler program determines a laminar separation bubble is present and large enough to affect the calculated profile drag if the decrease in velocity over the distance from where the turbulent boundary layer calculations begin to where $H_{32}=1.6$ is greater than 4.2% of the potential velocity. See, e.g., Eppler, R. and Somers, D. M.: Airfoil Design for Reynolds Numbers Between 50,000 and 500,000, *Proceedings of the Conference on Low Reynolds Number Airfoil Aerodynamics,* University of Notre Dame UNDAS-CP-77B123, June 1985, pp. 1–14. If the velocity reduction across the bubble is greater than 4.2%, the Eppler program will print a warning at that point on the drag polar. The warning is a triangle pointed up for a bubble on the low pressure surface and a triangle pointed down for a bubble on the higher pressure surface. It can only be assumed that if the bubbles are large enough to affect the drag, hence a bubble warning in the program, the bubble will be large enough to allow ventilation to occur. These bubble warnings can be seen on the 63A012 drag polar in FIG. 9 for conditions applicable to the close reach. The RACE 145 has no bubble warnings inside the skeg operating range.

For conservatism against laminar separation bubbles, the RACE 145 was run at ⅓ of the full scale Reynolds numbers. If laminar separation bubble warnings are not given at ⅓ of the Reynolds number, the full scale case will have drag as predicted and ventilation will not be a problem.

Figure 10:
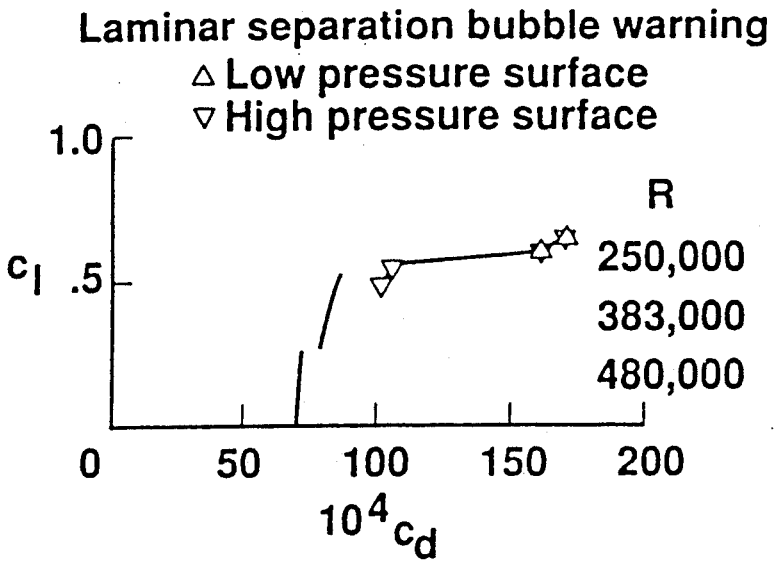

The drag polar for the ⅓ Reynolds number case is plotted in FIG. 10. The careful design of the cambered transition ramps has eliminated bubbles for the beam and broad reach points of sail. The section on the polar corresponding to the close reach indicate bubbles are present on the high pressure surface. Ventilation is not considered a possibility because of the near ambient pressures located at the bubble location.

Figure 11:
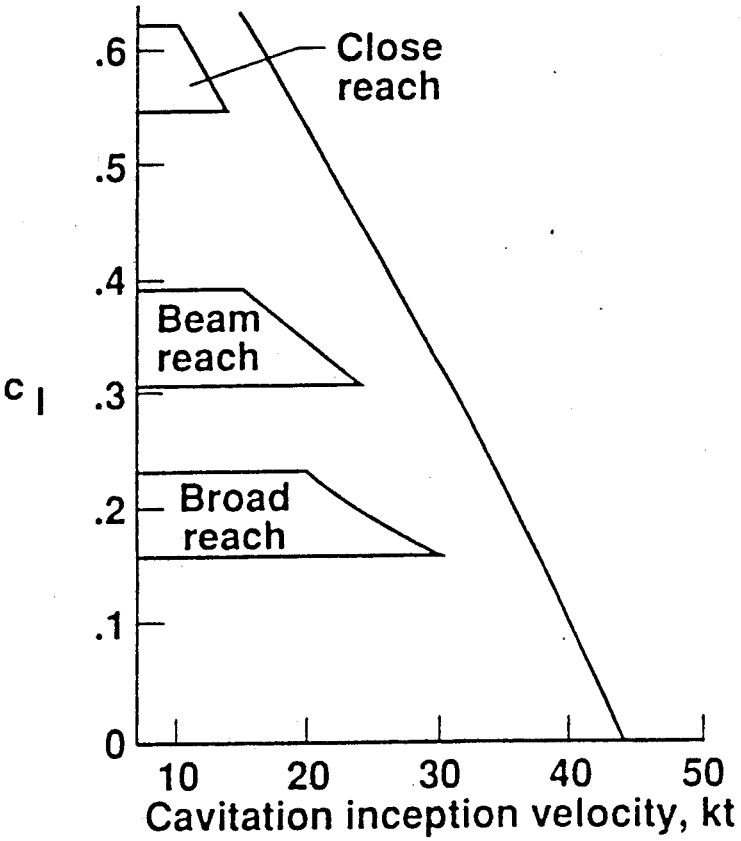
FIG. 11 is a graph of skeg section lift coefficients versus cavitation inception velocity.

The nearly constant velocity distributions required for laminar flow keep the minimum pressure higher than the water vapor pressure. FIG. 11 indicates the cavitation inception velocities are outside the hull operating range.

The lift producing device can be formed with the determined desired shape by conventional means such as molding or hand-shaping. For example, the lift producing device can be formed from a material capable of being shaped by molding, such as a composition including polyester resin and carbon fibers. A mold having a cavity having the determined desired shape is then charged with the composition and the composition is molded to form a lift producing device. The lift producing device can be molded integrally with or separately from the hull. Alternatively, the device can be hand-shaped from a material such as fiberglass.

CONCLUSION

The high performance sailboard spinout problem has been determined to be the result of skeg ventilation. Towing tank tests from several research facilities state ventilation is the result of air bleeding into the low energy region formed by separated flow on the skeg surface. Skeg manufacturers are presently designing skegs which physically or hydrodynamically block the passage of air into any separated region on the skeg, thus preventing ventilation. The methods used in production can prevent ventilation, but at the expense of higher drag. A direct solution to skeg ventilation is proposed which significantly lowers skeg drag.

A foil section has been designed utilizing the techniques of computer modeling the foil's pressure field and boundary layer. This foil section prevents ventilation by maintaining attached boundary layer flow throughout the skeg operating environment. Drag reductions of 17% to 29% have been obtained over commonly used symmetrical NACA sections. The large drag reductions are the result of maintaining laminar flow over 62% of the section chord while the sailboard is on the most frequently used points of sail. Cavitation is avoided by preventing low pressure peaks in the pressure distribution while the skeg is operated throughout its range.

While the preferred embodiment has been described in connection with a skeg for a sailboard, one of ordinary skill in the art will recognize that the present invention is not limited thereto. The present invention is also applicable to lift producing devices used in connection with other vehicles such as sailboats where ventilation is a problem.

What is claimed is:

1. A method for producing a lift producing device having opposed first and second major surfaces joined at a longitudinally extending leading edge and at a longitudinally extending trailing edge, at least a portion of said trailing edge being spaced from said leading edge by a predetermined mean chord length, said lift producing device being adapted to be connected to a vehicle and to provide lift to said vehicle when said vehicle is moved relative to a first fluid medium within a range of predetermined velocities, each of said velocities having a direction inclined from a plane extending through said leading edge and said trailing edge within a predetermined angular range, said first fluid medium having a first density, and viscosity and being in contact with a second fluid medium adjacent said vehicle, said second fluid medium having a second density different from said first density, and said first fluid medium being under a high pressure adjacent said first major surface of said lift producing device and being under a low pressure adjacent said second major surface of said lift producing device, said method comprising:

providing a material capable of being shaped;

specifying and predetermined mean chord length of said lift producing device;

determining said range of predetermined velocities and said predetermined angular range;

based on said predetermined mean chord length, said range of predetermined velocities, said predetermined angular range, said first density and said viscosity of said first fluid medium, determining at least one of a pressure distribution and a velocity distribution along said predetermined mean chord length such that said first fluid medium will exhibit attached laminar flow along said lift producing device for a portion of said predetermined mean chord length from said leading edge toward said trailing edge, will not form a laminar separation bubble adjacent said second major surface of said lift producing device and no turbulent separation occurs adjacent said second major surface of said lift producing device for substantially all of said predetermined mean chord length from said leading edge toward said trailing edge; wherein said at least one of pressure distribution and velocity distribution is determined such that said first fluid medium will exhibit attached laminar flow along said lift producing device for approximately the longest portion of said mean chord length possible while still exhibiting no turbulent separation adjacent said second major surface of said lift producing device for substantially all of said predetermined chord length from said leading edge toward said trailing edge;

calculating a cross-sectional shape which will generate said at least one of pressure distribution and velocity distribution when said vehicle is moved relative to said first fluid medium at a velocity within said range of predetermined velocities and an angle within said predetermined angular range; and shaping said material to form said lift producing device having said predetermined mean chord length and said cross-sectional shape.

2. A method according to claim 1, further comprising forming a mold having a cavity corresponding to said cross-sectional shape and said mean chord length, and charging said cavity with said material, wherein said shaping is accomplished by molding said material.

3. A method according to claim 1, wherein said cross-sectional shape is symmetrical with respect to said plane extending through said leading edge and said trailing edge.

4. A method according to claim 1, wherein said predetermined angular range is 0 to 8 degrees.

5. A lift producing device, adapted to be connected to a vehicle to provide lift to said vehicle when said vehicle is moved relative to a first fluid medium having a first density and viscosity and being in contact with a second fluid medium adjacent said vehicle, said second fluid medium having a second fluid density different from said first fluid density, comprising:

opposed first and second major surfaces joined at a longitudinally extending leading edge and at a longitudinally extending trailing edge, at least a portion of said longitudinally extending leading edge being spaced from said longitudinally extending trailing edge by a predetermined mean chord length, wherein when said vehicle is moved relative to said first fluid medium at a velocity within a range of predetermined velocities, each of said velocities having a direction inclined from a plane extending through said leading edge and said trailing edge within a predetermined angular range, a region of high pressure is generated in said first fluid medium adjacent said first major surface and a region of low pressure is generated in said first fluid medium adjacent said second major surface; and a cross-sectional shape which will generate a pressure distribution around said lift producing device when said vehicle is moved relative to said first fluid medium at a velocity with said range of predetermined velocities such that said first fluid medium exhibits attached laminar flow along said lift producing device for a portion of said predetermined mean chord length from said leading edge to said trailing edge and such that no laminar separation bubble occurs adjacent said second major surface and no turbulent separation occurs adjacent said second major surface for substantially all of said predetermined mean chord length from said leading edge to said trailing edge; wherein said portion of said mean chord length along which attached laminar flow is exhibited is approximately the longest length possible while still exhibiting no turbulent separation adjacent said second major surface of said lift producing device for substantially all of said predetermined chord length from said leading edge toward said trailing edge.

6. A lift producing device according to claim 5, wherein said cross-sectional shape is symmetrical with respect to said plane extending through said leading edge and said trailing edge.

7. In a sailboard including a hull having first and second major surfaces, a mast attached to said first major surface of said hull, a sail attached to said mast and a single lift producing device attached to said second major surface of said hull, the improvement wherein said lift producing device is a lift producing device according to claim 5.

8. A sailboard according to claim 7, wherein said predetermined angular range is 0° to 8°.

9. A sailboard according to claim 7, wherein said cross-sectional shape is symmetrical with respect to said plane extending through said leading edge and said trailing edge.

10. A lift producing device according to claim 5, wherein said predetermined angular range is 0 to 8 degrees.

* * * * *